US009885504B2

(12) United States Patent
Xu et al.

(10) Patent No.: US 9,885,504 B2
(45) Date of Patent: Feb. 6, 2018

(54) HEAT PUMP WITH WATER HEATING

(71) Applicant: TRANE INTERNATIONAL INC., Piscataway, NJ (US)

(72) Inventors: Liang Xu, Shanghai (CN); Yuqing Du, Shanghai (CN); Jun Wang, Shanghai (CN); Jing Lei, Shanghai (CN); Chungang Wang, Shanghai (CN); Guangyu Shen, Shanghai (CN)

(73) Assignee: TRANE INTERNATIONAL INC., Piscataway, NJ (US)

( * ) Notice: Subject to any disclaimer, the term of this patent is extended or adjusted under 35 U.S.C. 154(b) by 0 days.

(21) Appl. No.: 14/758,756

(22) PCT Filed: Dec. 31, 2012

(86) PCT No.: PCT/CN2012/088123
§ 371 (c)(1),
(2) Date: Jun. 30, 2015

(87) PCT Pub. No.: WO2014/101225
PCT Pub. Date: Jul. 3, 2014

(65) Prior Publication Data

US 2015/0338139 A1 Nov. 26, 2015

(51) Int. Cl.

| | |
|---|---|
| ***F25B 30/02*** | (2006.01) |
| ***F25B 13/00*** | (2006.01) |
| *F25B 47/02* | (2006.01) |

(52) U.S. Cl.
CPC ..... *F25B 30/02* (2013.01); *F25B 13/00* (2013.01); *F25B 47/025* (2013.01);
(Continued)

(58) Field of Classification Search
CPC ..... F25B 13/00; F25B 30/02; F25B 47/025; F25B 2313/021; F25B 2400/13; F25B 2313/009
(Continued)

(56) References Cited

U.S. PATENT DOCUMENTS

| | | | | |
|---|---|---|---|---|
| 4,528,822 A | | 7/1985 | Glamm | |
| 4,646,537 A | * | 3/1987 | Crawford | F24D 5/12 62/238.6 |

(Continued)

FOREIGN PATENT DOCUMENTS

| | | |
|---|---|---|
| CN | 100567852 | 12/2009 |
| CN | 201377933 Y | 1/2010 |

(Continued)

OTHER PUBLICATIONS

International Search Report and Written Opinion for International Application No. PCT/CN2012/088123, Dated Oct. 3, 2013, 7 pgs.

(Continued)

*Primary Examiner* — Mohammad M Ali
(74) *Attorney, Agent, or Firm* — Hamre, Schumann, Mueller & Larson, P.C.

(57) ABSTRACT

Heat pump systems and methods for providing chilled/hot liquid for air-conditioning and domestic hot-water, are provided. The heat pump systems include a first heat exchanger, a second heat exchanger and a third heat exchanger (e.g., a hot-water heat exchanger) that share at least one expansion valve disposed at a downstream position of the hot-water heat exchanger. The at least one expansion valve is disposed between the hot-water heat exchanger and the first and second heat exchangers. The heat pump systems can provide six operation modes, including a cooling mode, a heating
(Continued)

mode, a water-heating mode, a heat-recovery mode, a simultaneous heating and water heating mode, and a defrost mode.

8 Claims, 8 Drawing Sheets

(52) U.S. Cl.
CPC ... *F25B 2313/009* (2013.01); *F25B 2313/021* (2013.01); *F25B 2400/13* (2013.01)

(58) Field of Classification Search
USPC ..... 62/324.6
See application file for complete search history.

(56) References Cited

U.S. PATENT DOCUMENTS

| | | | | |
|---|---|---|---|---|
| 4,693,089 | A | 9/1987 | Bourne et al. | |
| 4,796,437 | A * | 1/1989 | James | F24H 4/04 62/238.6 |
| 4,940,079 | A * | 7/1990 | Best | F24D 19/1072 165/236 |
| 5,172,564 | A | 12/1992 | Reedy | |
| 5,906,104 | A | 5/1999 | Schwartz et al. | |
| 7,234,646 | B2 | 6/2007 | Saitoh et al. | |
| 7,237,394 | B2 * | 7/2007 | Rigal | F25B 45/00 62/149 |
| 8,056,348 | B2 | 11/2011 | Murakami et al. | |
| 8,628,025 | B2 * | 1/2014 | Bucknell | F01N 5/02 123/41.21 |
| 9,200,820 | B2 * | 12/2015 | Okazaki | F25B 13/00 |
| 2006/0064995 | A1 * | 3/2006 | Rigal | F25B 45/00 62/149 |
| 2006/0123835 | A1 * | 6/2006 | Takegami | F25B 13/00 62/498 |
| 2007/0209380 | A1 * | 9/2007 | Mueller | F25B 47/025 62/260 |
| 2011/0113808 | A1 * | 5/2011 | Ko | F25B 1/04 62/324.3 |
| 2011/0220729 | A1 * | 9/2011 | Bucknell | F01N 5/02 237/12.3 R |
| 2011/0289944 | A1 * | 12/2011 | Ouyang | B60H 1/00328 62/61 |
| 2015/0285539 | A1 * | 10/2015 | Kopko | F25B 5/02 62/115 |

FOREIGN PATENT DOCUMENTS

| | | |
|---|---|---|
| CN | 201449083 | 5/2010 |
| CN | 101900448 | 12/2010 |
| CN | 202382480 U | 8/2012 |
| CN | 102809248 A | 12/2012 |
| JP | 2002-277088 | 9/2002 |
| JP | 2004-125254 | 4/2004 |

OTHER PUBLICATIONS

Chinese Office Action, dated Aug. 1, 2016, Chinese Patent Application No. 201280078248.9 with English translation (14 pages).

* cited by examiner

HEAT PUMP WITH WATER HEATING

FIELD OF TECHNOLOGY

The embodiments disclosed herein relate generally to a heat pump system. More specifically, the embodiments described herein relate to a heat pump system that can heat up a liquid, such as water.

BACKGROUND

Heat pumps are reversible refrigeration systems capable of conditioning a space by heating or cooling the air within the space. Heat pumps can also be used for heating a liquid (e.g., water) for domestic or other purposes.

SUMMARY

The embodiments described herein relate to heat pump systems and methods for providing chilled/hot liquid such as for air-conditioning and/or such as for hot water used for example in residential applications.

The heat pump systems described herein can include a first heat exchanger, a second heat exchanger and a third heat exchanger (e.g., a hot-water heat exchanger). At least one expansion valve can be disposed at a downstream position of the hot-water heat exchanger and between the hot-water heat exchanger and the first and second heat exchangers. The at least one expansion valve can be fluidly connected to the first heat exchanger and/or the second heat exchanger and shared by the first, second and third heat exchangers. The terms "downstream" and "upstream" described herein refer to relative positions of components of a heat pump system through which refrigerant can flow in a refrigeration circle where a compressor is taken as the start point.

In one embodiment, compressed refrigerant from a compressor can be directed to two directions, one to a four-way valve and the other to a hot-water heat exchanger. Two valves can be utilized to control refrigerant flow to the two directions.

In some embodiments, the heat pump system includes an enhanced vapor injection (EVI) component. The EVI component can be disposed at a position downstream of the hot-water heat exchanger and upstream of the at least one expansion valve.

The heat pump systems described herein can provide six operation modes, including a cooling mode, a heating mode, a water-heating mode, a heat-recovery mode, a simultaneous heating and water heating mode, and a defrost mode.

The embodiments provided herein can work in an operation range, for example, a working temperature down to, for example, about −15° C., and increase a hot water outlet temperature to, for example, about 65° C., and make the heat pump system more energy-efficient and environmentally-friendly.

In one embodiment, a refrigeration circuit includes a compressor, a first heat exchanger, a second heat exchanger, a third heat exchanger, and at least one expansion valve being disposed at a downstream position of the third heat exchanger. The first, second and third heat exchangers share the at least one expansion valve that is disposed between the third heat exchanger and the first and second heat exchangers.

In another embodiment, a method for providing air-conditioning and/or hot water, is provided. Compressed refrigerant is directed to a hot-water heat exchanger for heating water. The refrigerant from the hot-water heat exchanger is directed to an expansion valve. The expansion valve is shared with a first heat exchanger and/or a second heat exchanger. The expansion valve is disposed between the hot-water heat exchanger and the first and second heat exchangers. The second heat exchanger is configured to provide air-conditioning.

BRIEF DESCRIPTION OF THE DRAWINGS

Referring now to the drawings in which like reference numbers represent corresponding parts throughout.

DETAILED DESCRIPTION

The embodiments described herein relate to heat pump systems and methods for providing chilled/hot liquid such as for air-conditioning and/or such as for hot water used for example in residential applications. The heat pump systems described herein can include a first heat exchanger, a second heat exchanger and a third heat exchanger e.g., a hot-water heat exchanger). At least one expansion valve can be disposed at a downstream position of the hot-water heat exchanger and between the hot-water heat exchanger and the first and second heat exchangers. The at least one expansion valve can be fluidly connected to the first heat exchanger and the second heat exchanger and shared by the first, second and third heat exchangers.

In one embodiment, compressed refrigerant from a compressor can be directed to two directions, one to a four-way valve and the other to a hot-water heat exchanger. Two valves can be utilized to control refrigerant flow to the two directions.

In some embodiments, the heat pump system includes an enhanced vapor injection (EVI) component. The EVI component can be disposed at a position downstream of the hot-water heat exchanger and upstream of the at least one expansion valve.

The heat pump systems described herein can provide six operation modes, including a cooling mode, a heating mode, a water-heating mode, a heat-recovery mode, a simultaneous heating and water heating mode, and a defrost mode.

References are made to the accompanying drawings that form a part hereof, and in which is shown by way of illustration of the embodiments in which the methods and systems described herein may be practiced. The term "heat pump circuit" generally refers to, for example, a reversible vapor-compressing refrigeration circuit including a compressor, at least two heat exchangers, and at least one expansion valve.

Figure 1:
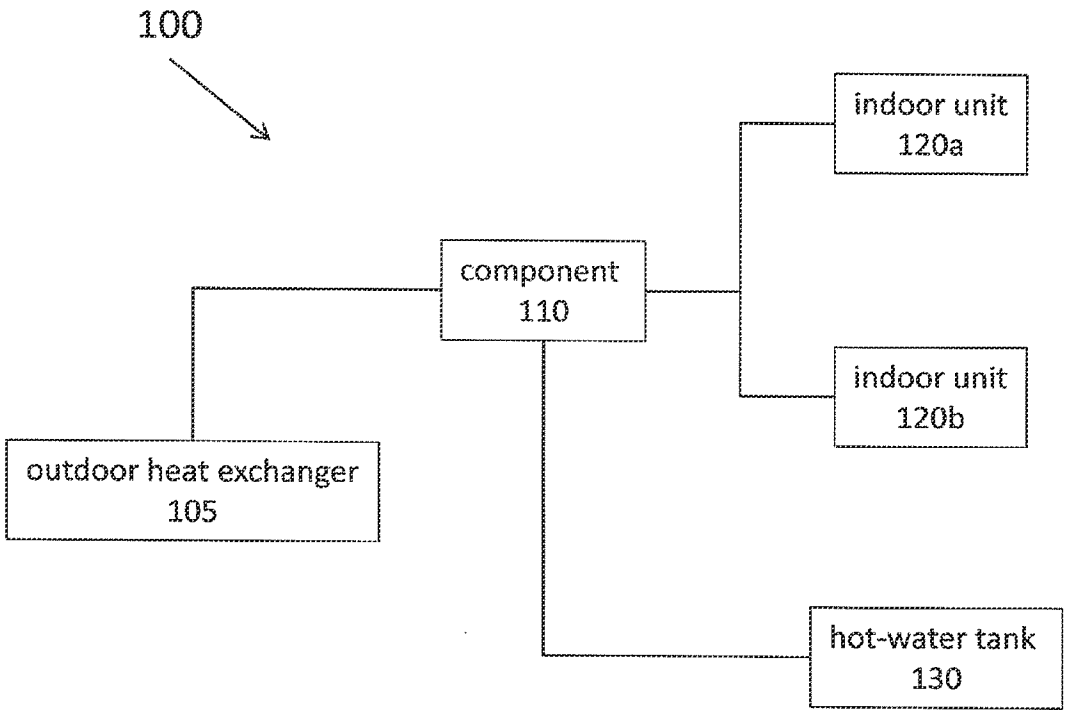
FIG. 1 illustrates a schematic diagram of a heat pump system, according to one embodiment.

FIG. 1 illustrates a schematic diagram of a heat pump system 100 including a heat pump circuit that includes a hot-water heat exchanger for supplying hot water, according to one embodiment. The heat pump system 100 includes a component 110. The component 110 can integrate a refrigeration circuit including a compressor such as, for example, a compressor 1 shown in FIG. 2, an expansion valve such as, for example, an expansion valve 8 shown in FIG. 2, a hot-water heat exchanger such as, for example, a hot-water heat exchanger 14 shown in FIG. 2, a first heat exchanger such as a first heat exchanger 3 shown in FIG. 2, a second heat exchanger such as a second heat exchanger 10 shown in FIG. 2, and valves such as, for example valves 16 and 17 shown in FIG. 2, for controlling refrigerant flow. The heat pump system 100 further includes an outdoor heat exchanger 105 and indoor units 120*a-b* that are fluidly connected to the component 110. In one embodiment, the outdoor heat exchanger 105 can be, for example, a geothermal heat exchanger. The outdoor heat exchanger 105 can use water as a heat exchange medium to conduct a heat exchange with a geothermal source. A geothermal heat exchanger and a geothermal source are well known. The indoor unit 120*a* can be, for example, an indoor heat exchanger for cooling indoor air. The indoor unit 120*b* can be, for example, an indoor heat exchanger for heating an indoor floor.

The heat pump system 100 further includes a hot-water tank 130 that is in fluid communication with the hot-water heat exchanger of the component 110. It is to be understood that the hot-water heat exchanger can be integrated with the hot-water tank 130.

The component 110 can supply chilled water to the indoor unit 120*a* for cooling indoor air, supply warm water to the indoor unit 120*a* for heating the indoor air, supply warm water to the indoor unit 120*b* for floor heating, and/or heat the water of the hot-water tank 130.

In some embodiments, when the hot-water heat exchanger is in the component 110, water can be circulated between the hot-water tank 130 and the component 110. The hot-water heat exchanger can heat up the water to be circulated. When the hot-water heat exchanger is integrated with the hot-water tank 130, the component 110 can supply refrigerant to the hot-water heat exchanger to heat up the water in the hot water tank 130. The warm water can be supplied to a water-to-water heat exchanger of the hot-water tank 130.

In some embodiments, when in a cooling mode, the component 110 can supply chilled air-conditioning water to the indoor unit 120*a* where the chilled air-conditioning water can take an amount of thermal energy away from the indoor air to cool down the indoor air and heat the air-conditioning water. The component 110 can take the amount of thermal energy away from the heated air-conditioning water through the first heat exchanger to cool down the air-conditioning water. The component 110 can bring that amount of thermal energy plus a component power input into a source water through the second heat exchanger to heat the source water. The heated source water can bring the thermal energy into the ground through the outdoor heat exchanger 105.

In some embodiments, when in a heating mode, the component 110 can take an amount of thermal energy away from the source water through the second heat exchanger to cool the source water. The cool source water can take an amount of thermal energy away from the ground through the outdoor heat exchanger 105 to heat the source water. The component 110 can bring that amount of thermal energy plus a component power input into the air-conditioning water through the first heat exchanger to heat the air-conditioning water, then supply the heated air-conditioning water to the indoor unit 120*a* or 120*b* to heat the indoor air.

The heat pump system 100 can achieve cooling/heating of a space and heating of water at the same time via the hot-water heat exchanger. In one embodiment, the hot-water heat exchanger can be a unit through which tap water is pumped and heated by refrigerant passing therethrough. The heated tap water can be circulated out of and back to a domestic hot water heater.

Figure 2:
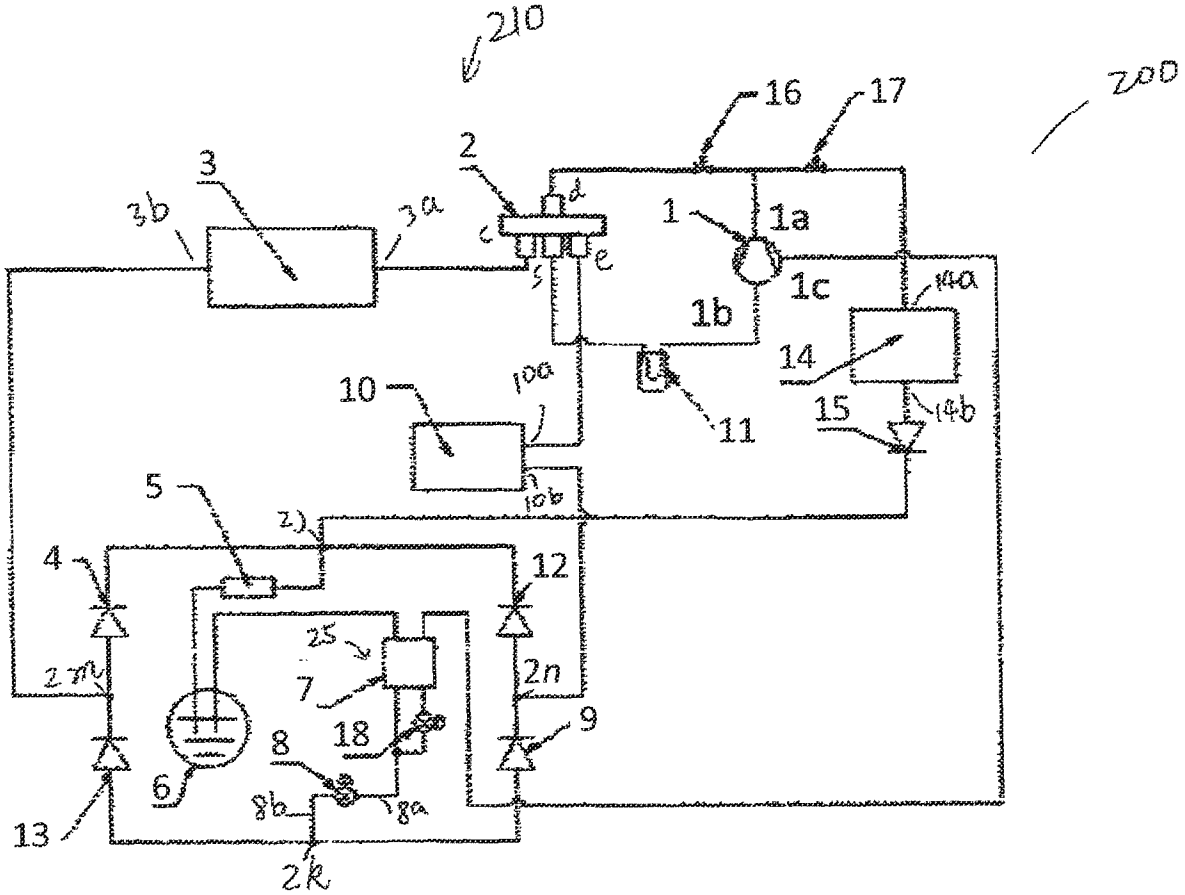
FIG. 2 illustrates a schematic diagram of a heat pump system, according to one embodiment.

FIG. 2 illustrates a heat pump system 200 that includes a heat pump circuit 210. The heat pump circuit 210 includes a compressor 1 having an outlet 1*a*, a first inlet 1*b*, and a second inlet 1*c*. Refrigerant from the outlet 1*a* can be directed to two directions, one to a four-way valve 2 and the other to a hot-water heat exchanger 14, via valves 16, 17, respectively. The valves 16 and 17 can be solenoid valves or other suitable valves for controlling refrigerant flow. The hot-water heat exchanger 14 includes an inlet 14*a* for receiving refrigerant from the compressor 1 and an outlet 14*b* for directing the refrigerant to a conjunction 2*j* of the heat pump circuit 210 via a valve 15.

A four-way valve described herein such as the four-way valve 2, includes four ports d, c, s and e for controlling refrigerant flows. The four-way valve can be set in a first state (e.g., powered-off) or a second state (e.g., powered-on). When the four-way valve is in the first state (e.g., powered-off), refrigerant flowing into the port d can flow out from the port c and refrigerant flowing into the port e can flow out from the port s. When the four-way valve is in the second state (e.g., powered-on), refrigerant flowing into the port d can flow out from the port e and refrigerant flowing into the port c can flow out from the port s.

The heat pump circuit 210 further includes a first heat exchanger 3, and a second heat exchanger 10, in addition to the hot-water heat exchanger 14 (third heat exchanger). The first heat exchanger 3 includes a first in/out port 3*a* fluidly connected to the port c of the four-way valve 2 and a second in/out port 3*b* fluidly connected to a conjunction 2*m* of the heat pump circuit 210. The second heat exchanger 10 includes a first in/out port 10*a* fluidly connected to the port e of the four-way valve 2 and a second in/out port 10*b* fluidly connected to a conjunction 2*n* of the heat pump circuit 210. Refrigerant from the conjunctions 2*m* and/or 2*n* can be directed to the conjunction 2*j* via the control of valves 4 and/or 12.

The first in/out port 3*a* of the first heat exchanger 3 can be fluidly connected to the outlet 1*a* or the first inlet 1*b* of the compressor 1, via the control of the four-way valve 2 and the valve 16. The first in/out port 10*a* of the second heat exchanger 10 can be fluidly connected to the outlet 1*a* or the first inlet 1*b* of the compressor 1, via the control of the four-way valve 2 and the valve 16. Compressed refrigerant from the outlet 1*a* of the compressor 1 can flow into the first input port 3*a* or 10*a*. The first inlet 1*b* of the compressor 1 can receive refrigerant from the first in/out port 3*a* or 10*a*.

In one embodiment, the first heat exchanger 3 can be an outdoor heat exchanger through which outdoor air can be drawn in to form a heat exchange relationship with refrigerant passing through the first heat exchanger 3. In another embodiment, the first heat exchanger 3 can be an intermediate heat exchanger through which refrigerant passing therethrough has a heat exchange with a liquid (e.g., water).

The liquid circulates inside a geothermal heat exchanger such as the outdoor heat exchanger 105 shown in FIG. 1 to exchange heat with the geothermal source.

In one embodiment, the second heat exchanger 10 can be an indoor heat exchanger through which indoor air can be blown in a heat exchange relationship with refrigerant passing through the second heat exchanger. In another embodiment, the second heat exchanger 10 can be an indoor heat exchanger through which liquid (e.g., water) can be circulated in a heat exchange relationship with refrigerant passing through the second heat exchanger. The cooled/heated liquid can be utilized to cool/heat indoor air.

It is to be understood that the first and second heat exchangers 3 and 10 can be any suitable heat exchanger as long as the refrigerant passing therethrough can conduct a heat exchange with another heat exchanging medium.

In one embodiment, the hot-water heat exchanger 14 can be a condenser that is a unit through which a liquid (e.g., water) is pumped in a heat exchange relationship with refrigerant passing through the hot-water heat exchanger 14. The liquid pumped through the hot-water heat exchanger 14 can be water circulated out of and back to a domestic/residential hot water heater. That is, the hot-water heat exchanger 14 is configured to conduct a direct or indirect heat exchange between the refrigerant and the water.

In the embodiment shown in FIG. 2, the heat pump circuit 210 farther includes an EVI component 25. The EVI component 25 is disposed at a downstream position of the third heat exchanger 14 and connected to the outlet 14*h* of the third heat exchanger 14 via a valve 15. The valve 15 allows refrigerant to flow from the third heat exchanger 14 to the EVI component 25 and blocks refrigerant flow is the opposite direction. The EVI component 25 includes an economizer 7 and an expansion valve 18. The EVI component 25 is configured to receive refrigerant from a condenser such as, for example, from the first heat exchanger 3, the second heat exchanger 10, and/or the hot-water heat exchanger 14, and to cool the refrigerant flow therethrough. It is to be understood that in other embodiments, the EVI component 25 can be optional.

In one embodiment, a portion of refrigerant through the economizer 7 can be extracted from the economizer 7 and expanded through the expansion valve 18. The expanded refrigerant is vaporized to cool down the refrigerant that flows through the economizer 7. The refrigerant vapor is injected back into the second inlet 1*c* of the compressor 1, in one embodiment, the expansion valve 18 can be capillary, thermal expansion valve, or an electronic expansion valve.

In the embodiment shown in FIG. 2, the heat pump circuit 210 further includes an expansion valve 8 that is fluidly connected to the EVI component 25. In one embodiment, the expansion valve 8 can be an electronic expansion valve. The expansion valve 8 is disposed at a downstream location of the EVI component 25. The expansion valve 8 has an inlet 8*a* for receiving refrigerant from the EVI component 25 and an outlet 8*b* for directing the refrigerant to a conjunction 2*k* of the heat pump circuit 210. The refrigerant from the conjunction 2*k* can be directed to the conjunction 2*m* and/or the conjunction 2*n* via the control of valves 9 and/or 13.

Via the valves 4 or 12, refrigerant from the first heat exchanger 3 or the second heat exchanger 10 can be received by the inlet 8*a* of the expansion valve 8. Via the valves 13 or 9, refrigerant from outlet 8*b* of the expansion valve 8 can be directed to the first heat exchanger 3 or the second heat exchanger 10. In the embodiment of FIG. 2, the valves 4, 12, 13 and 9 each are a one-way valve that allows refrigerant to flow in one direction and blocks refrigerant flow in an opposite direction.

The expansion valve 8 is fluidly connected to the first heat exchanger 3, the second heat exchanger 10, and/or the hot-water heat exchanger 14, depending on the specific mode the heat pump circuit 210 works on, which will be described further below.

A dry filter 5 and a receiver 6 are connected in series for filtering refrigerant before the refrigerant enters the EVI component 25. An accumulator 11 is connected to the port s of the four-way valve 2 and to the first inlet 1*b* of the compressor 1. The function of an accumulator is known in the art. It is to be understood that the dry filter 5, the receiver 6 and the accumulator 11 can be optional. It is to be understood that the extracted refrigerant from the EVI component 25 can be directed to the accumulator 11.

FIGS. 2*a-f* illustrate the heat pump system 200 that works in six different modes, respectively. FIGS. 2*a-f* differ in the position of selected valves and illustrate different refrigerant flow paths within the heat pump circuit 210 for different operation modes. In one embodiment, the heat pump system 200 can utilize a geothermal source as a heat sink/source.

Figure 2A:
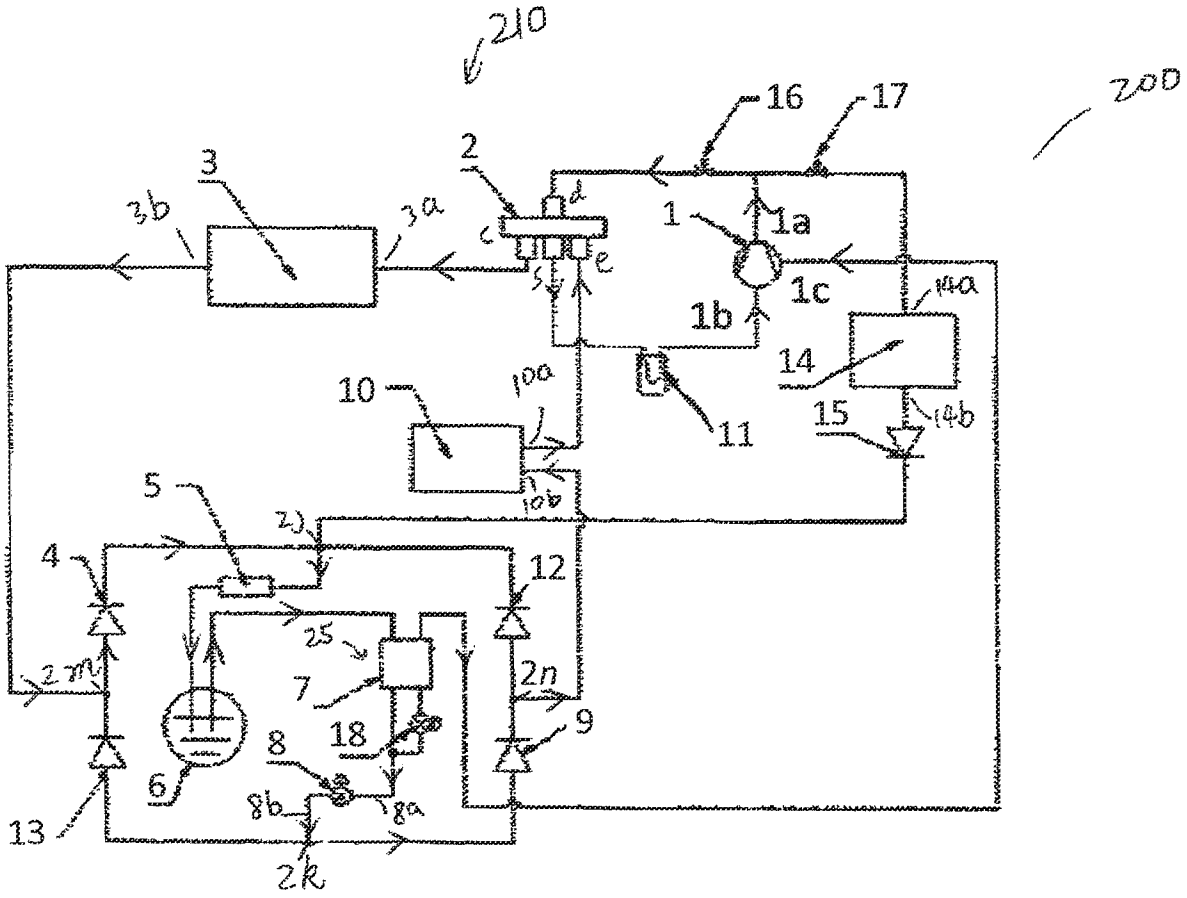
FIG. 2*a* illustrates a schematic diagram of the heat pump system of FIG. 2 in a cooling mode, according to one embodiment.

FIG. 2*a* illustrates a schematic diagram of the heat pump system 200 in a cooling mode, according to one embodiment. In the cooling mode of operation, the heat pump circuit 210 achieves cooling of a space. The compressor 1 discharges compressed refrigerant via the outlet 1*a*. The valve 16 is opened and the valve 17 is closed. The four-way valve 2 is in the first state (e.g., powered-off). The discharged refrigerant flows through the valve 16 and the ports d and c of the four-way valve 2, and is directed to the first heat exchanger 3. In one embodiment, the first heat exchanger 3 can be an outdoor exchanger where another heat exchanging medium can conduct a heat exchange with the refrigerant and absorb heat from the refrigerant for condensing the refrigerant. Condensed refrigerant flows out of the first heat exchanger 3, through the valve 4, the filter 5 and the receiver 6, and is directed through the EVI component 25 to cool down. The refrigerant is then directed to the expansion valve 8. The refrigerant from the expansion valve 8 then flows through the valve 9 and is directed into the second heat exchanger 10 that can act as an evaporator. In one embodiment, the second heat exchanger 10 can be an indoor heat exchanger where the refrigerant is vaporized by, for example, receiving heat from indoor air being blown through the second heat exchanger 10. Thus the indoor air can be cooled to achieve cooling of the space. Refrigerant vapor out of the second heat exchanger 10 is directed through the ports e, s of the four-way valve 2, through the accumulator 11, and back to the compressor 1 via the first inlet 1*b*. In the cooling mode the third heat exchanger 14 is idle. In some embodiments, the idle third heat exchanger 14 can be used to store liquid refrigerant.

Figure 2B:
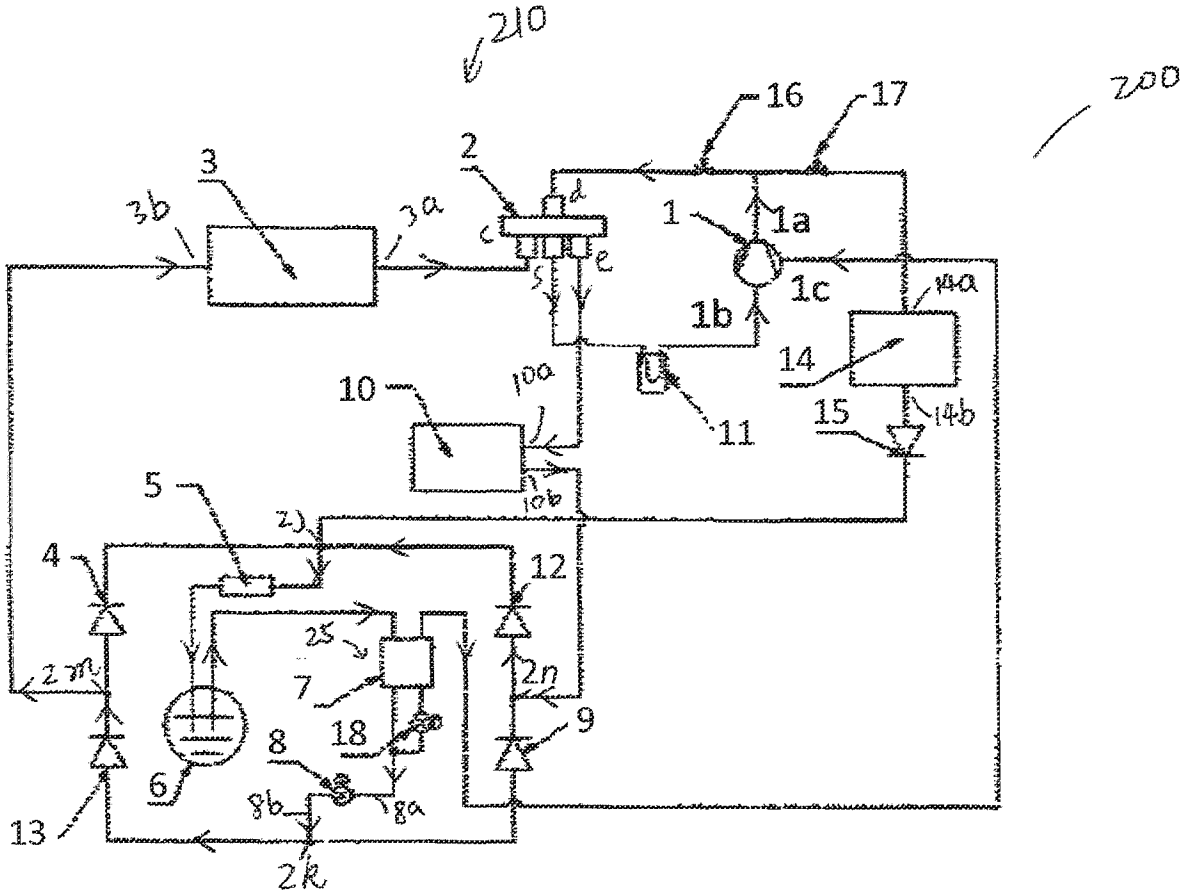
FIG. 2*b* illustrates a schematic diagram of the heat pump system of FIG. 2 in a heating mode, according to one embodiment.

FIG. 2*b* illustrates a schematic diagram of the heat pump system 200 in a heating mode, according to one embodiment. In the heating mode of operation, the heat pump circuit 210 achieves heating of a space. The compressor 1 discharges gaseous refrigerant via the outlet 1*a*. The valve 16 is opened and the valve 17 is closed. The four-way valve 2 is in the second state (e.g., powered-on). The discharged refrigerant flows through the valve 16 and the ports d and e of the four-way valve 2 to the second heat exchanger 10 where indoor air can absorb heat from the refrigerant for heating the space. In one embodiment, the second heat exchanger 10 can be an indoor exchanger where indoor air is blown through the second heat exchanger 10 to condense the refrigerant passing therethrough. As a result the indoor air passing across the second heat exchanger 10 is heated. In another embodiment, the second heat exchanger 10 can be an indoor exchanger where liquid (e.g., cool water) is circulated therethrough to condense the refrigerant passing therethrough. The heated liquid is utilized to heat indoor air. It is to be understood that in other embodiments, the heated liquid can be used for other purposes. The condensed refrigerant flows out of the second heat exchanger 10, flows through the valve 12, the filter 5 and the receiver 6, and is directed through the EVI component 25 to cool down. The refrigerant is then directed to the expansion valve 8. The refrigerant then flows through the valve 13 and is directed into the first heat exchanger 3. In one embodiment, the first heat exchanger 3 can be an outdoor exchanger where a geothermal source can act to absorb heat from the refrigerant gas flows through the first heat exchanger 3. In one embodiment, the first heat exchanger 3 can be an outdoor heat exchanger where the refrigerant can be vaporized by receiving heat from the outdoor air being blown through the first heat exchanger 3. Refrigerant vapor out of the first heat exchanger 3 is directed through the ports c, s of the four-way valve 2, through the accumulator 11, and back to the compressor 1 via the first inlet 1*b*. In the heating mode the third heat exchanger 14 is idle. In some embodiments, the idle third heat exchanger 14 can be used to store liquid refrigerant.

Figure 2C:
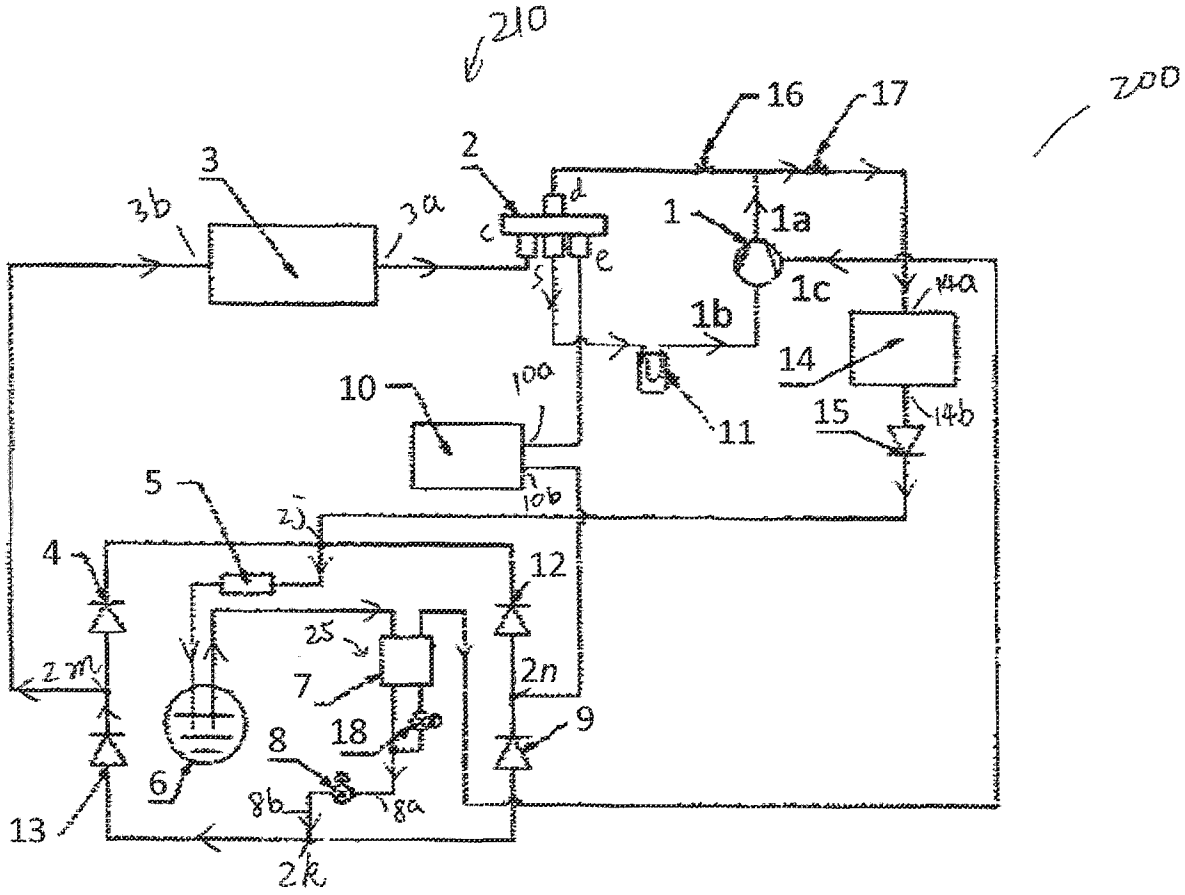
FIG. 2*c* illustrates a schematic diagram of the heat pump system of FIG. 2 in a water-heating mode, according to one embodiment.

FIG. 2*c* illustrates a schematic diagram of the heat pump system 200 in a water heating mode, according to one embodiment. In the water heating mode of operation, the heat pump circuit 210 achieves heating of a liquid. The compressor 1 discharges compressed refrigerant via the outlet 1*a*. The valve 16 is closed and the valve 17 is open. The four-way valve 2 is in a second state (e.g., powered-on). The discharged refrigerant flows through the valve 17 to the third heat exchanger 14. In one embodiment, the third heat exchanger 14 can be a hot-water heat exchanger where a liquid (e.g., water) is circulated through the third heat exchanger 14. The circulated liquid condenses the refrigerant vapor passing therethrough and the liquid itself is heated to achieve heating of the liquid. The condensed refrigerant flows out of the third heat exchanger 14, flows through the valve 15, the filter 5 and the receiver 6, and is directed through the EVI component 25 to cool down. The refrigerant is then directed to the expansion valve 8. The refrigerant from the expansion valve 8 then flows through the valve 13 and is directed into the first heat exchanger 3 to be vaporized by the receipt of heat. In one embodiment, the first heat exchanger 3 can be an outdoor exchanger where a heat exchange medium can act to absorb heat from the refrigerant gas. Refrigerant vapor out of the first heat exchanger 3 is directed through the ports c, s of the four-way valve 2, through the accumulator 11, and back to the compressor 1 via the first inlet 1*b*. In the water heating mode the second heat exchanger 10 is idle. In one embodiment, the second heat exchanger 10 can be an indoor heat exchanger located in an indoor space. During the water heating mode of operation, air in the indoor space can be unaffected as the second heat exchanger 10 can be idle. In some embodiments, the idle second heat exchanger 10 can be used to store liquid refrigerant.

Figure 2D:
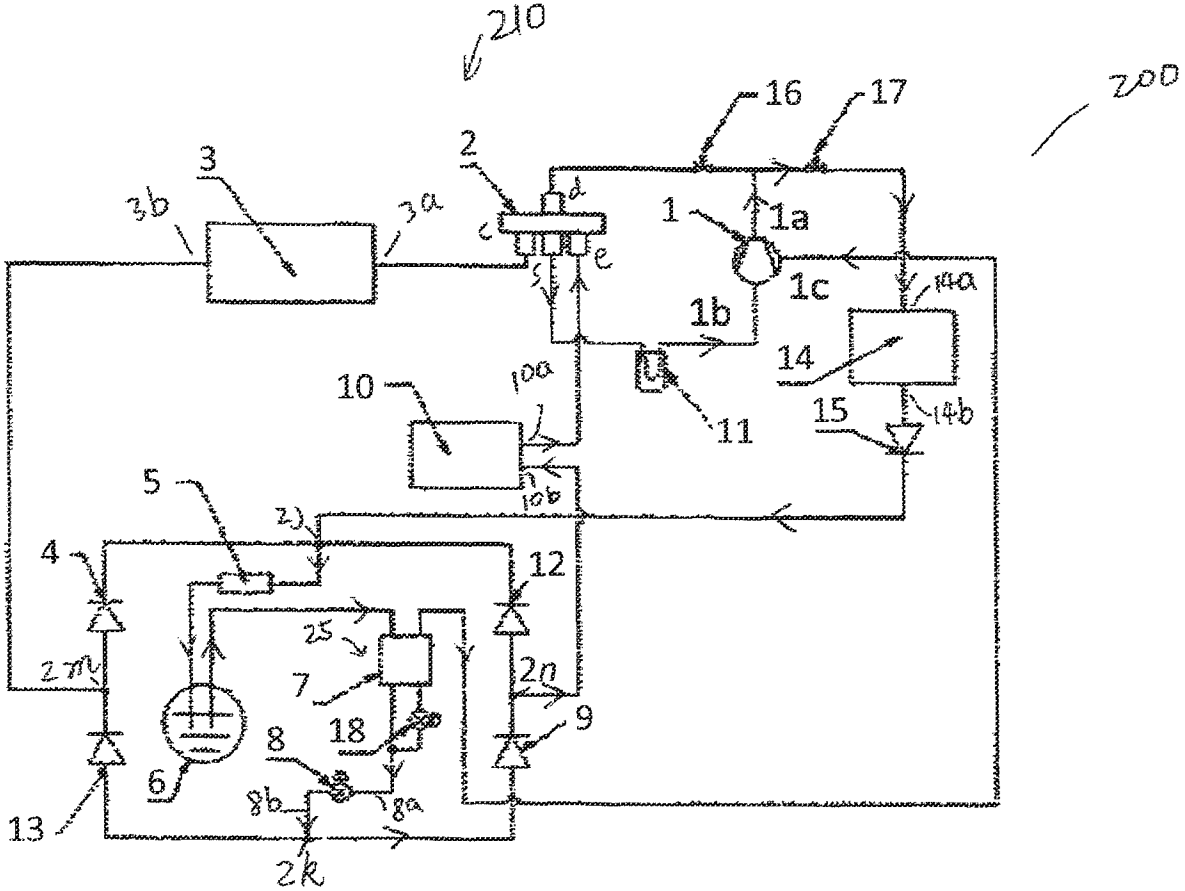
FIG. 2*d* illustrates a schematic diagram of the heat ump system of FIG. 2 in a heat-recovery mode, according to one embodiment.

FIG. 2*d* illustrates a schematic diagram of the heat pump system 200 in a heat-recovery mode, according to one embodiment. In the heat-recovery mode of operation, the heat pump circuit 210 achieves heating of a liquid and cooling of a space utilizing the liquid as a heat sink simultaneously. The compressor 1 discharges compressed refrigerant via the outlet 1*a*. The valve 16 is closed and the valve 17 is opened. The four-way valve 2 is in the first state (e.g., powered-off). The discharged refrigerant flows through the valve 17 to the third heat exchanger 14. In one embodiment, the third heat exchanger 14 is a hot-water heat exchanger where a liquid (e.g., water) is circulated through the third heat exchanger 14. The circulated liquid condenses the refrigerant vapor passing therethrough and the liquid itself is heated to achieve heating of the liquid. The condensed refrigerant flows out of the third heat exchanger 14, flows through the valve 15, the filter 5 and the receiver 6, and is directed through the EVI component 25 to cool down. The refrigerant is then directed to the expansion valve 8. The refrigerant from the expansion valve 8 then flows through the valve 9 and is directed into the second heat exchanger 10. In one embodiment, the second heat exchanger 10 can be an indoor heat exchanger where the refrigerant is vaporized by receiving heat from the indoor air being blown through the second heat exchanger 10. The indoor air is cooled to achieve cooling of the space. Refrigerant vapor out of the second heat exchanger 10 is directed through the ports e, s of the four-way valve 2, through the accumulator 11, and back to the compressor 1 via the first inlet 1*b*. In the heat-recovery mode the first heat exchanger 3 is idle. In some embodiments, the idle first heat exchanger 3 can be used to store liquid refrigerant.

Figure 2E:
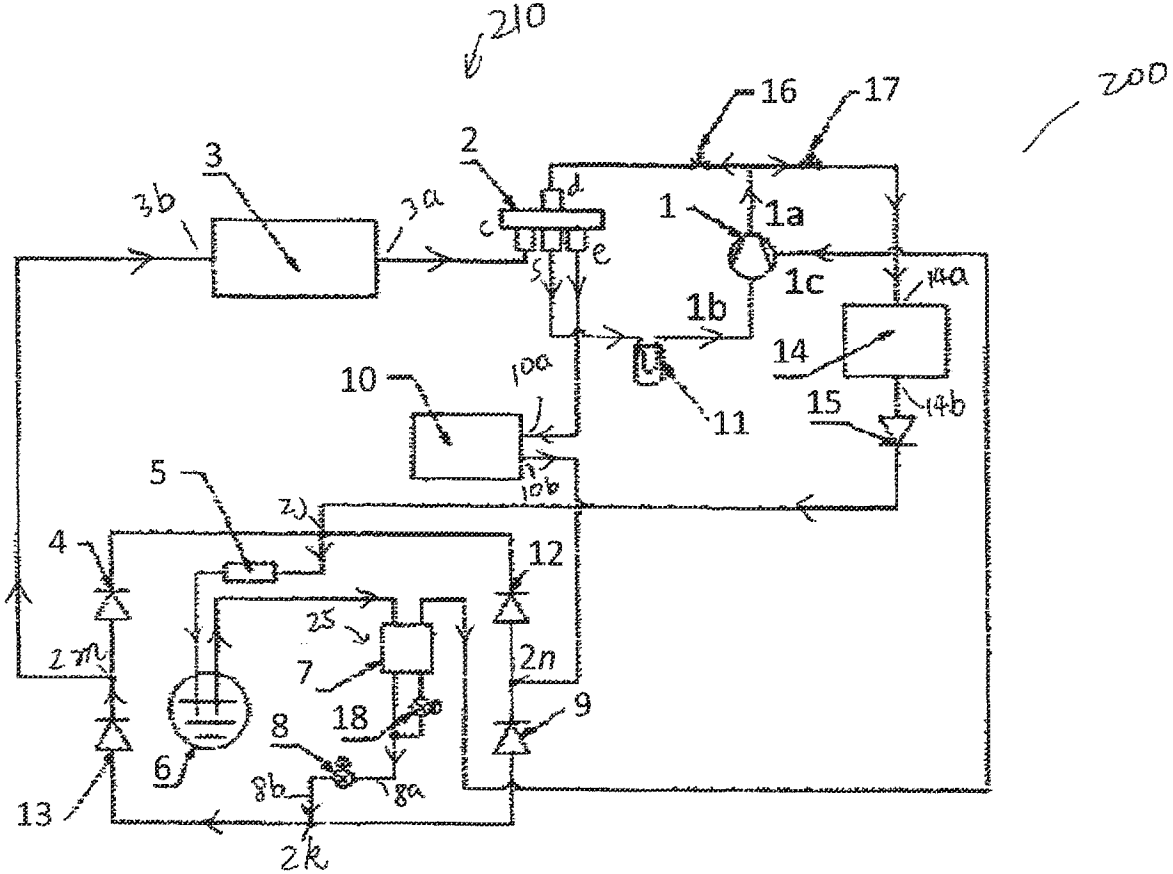
FIG. 2*e* illustrates a schematic diagram of the heat pump system of FIG. 2 in a heating and water-heating mode, according to one embodiment.

FIG. 2*e* illustrates a schematic diagram of the heat pump system 200 in the heating and water heating mode, according to one embodiment. In the heating and water heating mode of operation, the heat pump circuit 210 achieves heating of a space and heating of a liquid simultaneously, utilizing, for example, outdoor air as a heat source. The compressor 1 discharges compressed refrigerant via the outlet 1*a*. The valves 16 and 17 are opened. The four-way valve 2 is in the second state (e.g., powered-on). The discharged refrigerant is divided into a first flow and a second flow passing through the valves 16 and 17, respectively.

The first flow is directed through the ports d and e of the four-way valve 2 to the second heat exchanger 10 where indoor air can absorb heat from the refrigerant for heating the space. In one embodiment, the second heat exchanger 10 can be circulated with water for exchanging heat with refrigerant passing through the second heat exchanger 10. The hot water is for air-conditioning an indoor space. In another embodiment, the second heat exchanger 10 can be an indoor exchanger where indoor air is blown through the second heat exchanger 10 to condense the refrigerant passing therethrough. As a result the indoor air passing across the heat exchanger is heated to achieve heating of the space. The condensed first flow of refrigerant flows out of the second heat exchanger 10, and flows through the valve 12 and to the conjunction 2*j*.

The second flow of refrigerant flows through the valve 17 to the third heat exchanger 14. As shown in FIG. 2*e*, the third heat exchanger 14 is a hot-water heat exchanger where a liquid (e.g., water) is circulated through the third heat exchanger 14. The circulated liquid condenses the refrigerant vapor passing therethrough and the liquid itself is heated to achieve heating of the liquid. The condensed second flow of refrigerant flows out of the third heat exchanger 14, and flows through the valve 15 and to the conjunction 2*j*.

The first and second flows of refrigerant converge at the conjunction 2*j*. The converged refrigerant flows through the filter 5 and the receiver 6, and is directed through the EVI component 25 to cool down. The refrigerant is then directed to the expansion valve 8. The refrigerant from the expansion valve 8 then flows through the valve 13 and is directed into the first heat exchanger 3 to be vaporized by the receipt of heat. In one embodiment, the first heat exchanger 3 is an outdoor heat exchanger where the refrigerant is vaporized by, for example, receiving heat from the outdoor air being blown through the first heat exchanger 3. Refrigerant vapor out of the first heat exchanger 3 is directed through the ports c, s of the four-way valve 2, through the accumulator 11, and back to the compressor 1 via the first inlet 1*b*.

Figure 2F:
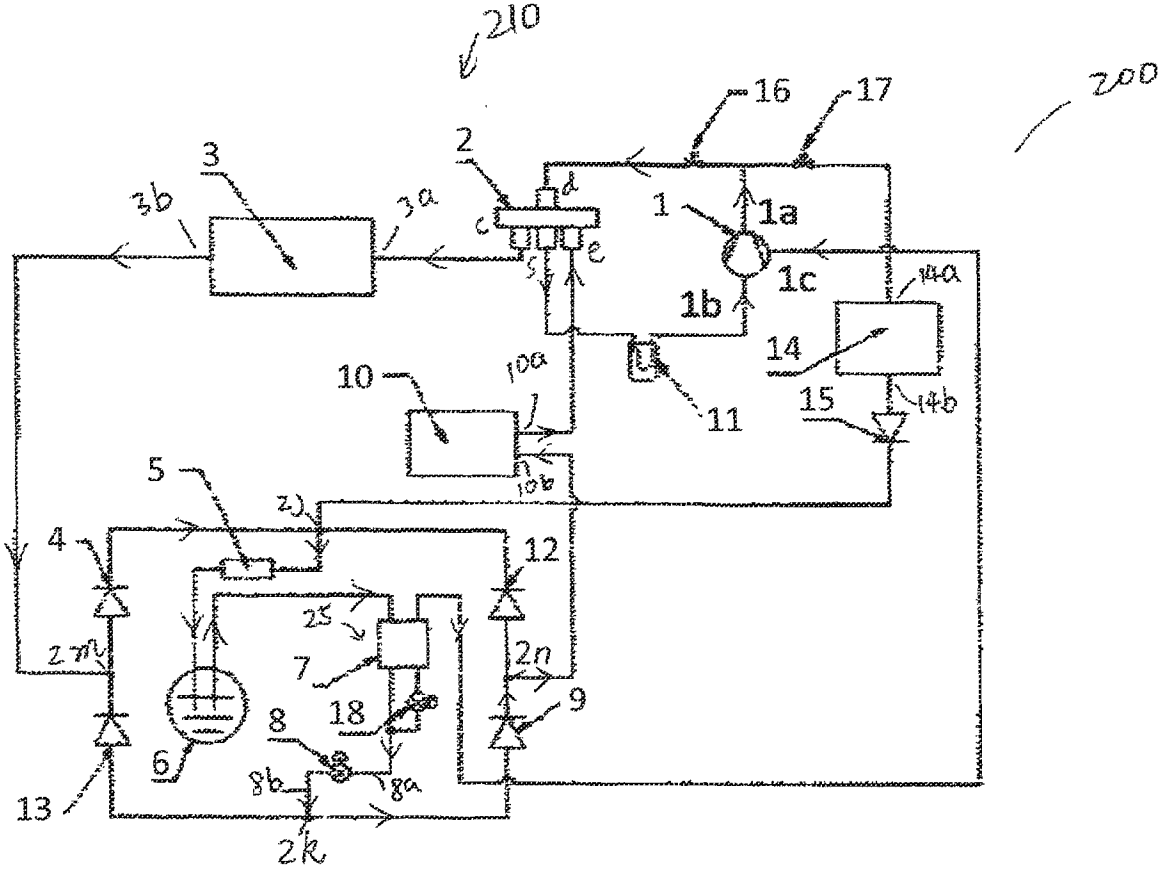
FIG. 2*f* illustrates a schematic diagram of the heat pump system of FIG. 2 in a defrost mode, according to one embodiment.

FIG. 2*f* illustrates a schematic diagram of the heat pump system 200 in the defrost mode, according to one embodiment. In the defrost mode of operation, the heat pump circuit 210 achieves melting frost on the first heat exchanger 3. The compressor 1 discharges compressed refrigerant via the outlet 1*a*. The valve 16 is opened and the valve 17 is closed. The four-way valve 2 is in the first state (e.g., powered-off). The discharged refrigerant flows through the valve 16 and the ports d and c of the four-way valve 2, and is directed to the first heat exchanger 3. In one embodiment, the first heat exchanger 3 can be an outdoor exchanger that may have frost thereon. The refrigerant flowing through the outdoor exchanger can heat the outdoor exchanger and melt the frost thereon to achieve defrosting the first heat exchanger 3. In some embodiments, the first heat exchanger can use another heat exchanging medium (e.g., outdoor air) to conduct a heat exchange with the refrigerant and absorb heat from the refrigerant for condensing the refrigerant. In some embodiments, the first heat exchanger 3 can stop drawing outdoor air so as to accelerate melting of the frost on the first heat exchanger 3 and the refrigerant can be condensed during defrosting the first heat exchanger 3. Condensed refrigerant flows out of the first heat exchanger 3, through the valve 4, the filter 5 and the receiver 6, and is directed through the EVI component 25 to cool down. The refrigerant is then directed to the expansion valve 8. The refrigerant from the expansion valve 8 then flows through the valve 9 and is directed into the second heat exchanger 10 that can act as an evaporator. In one embodiment, the second heat exchanger 10 can be an indoor heat exchanger where the refrigerant is vaporized by, for example, receiving heat from indoor air being blown through the second heat exchanger 10. Thus the indoor air can be cooled to achieve cooling of the space. Refrigerant vapor out of the second heat exchanger 10 is directed through the ports e, s of the four-way valve 2, through the accumulator 11, and back to the compressor 1 via the first inlet 1*b*. In the defrost mode the third heat exchanger 14 is idle. In some embodiments, the idle third heat exchanger 14 can be used to store liquid refrigerant.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

The invention claimed is:

1. A refrigeration circuit, comprising:

a compressor;

a first heat exchanger;

a second heat exchanger;

a third heat exchanger; and at least one expansion valve being disposed at a downstream position of the third heat exchanger, wherein the first, second and third heat exchangers share the at least one expansion valve, and the at least one expansion valve is disposed between the third heat exchanger and the first and second heat exchangers, wherein the refrigeration circuit is operable in a plurality of modes including a cooling mode, a heating mode, a water-heating mode, a heat-recovery mode, a simultaneous heating and water heating mode, and a defrost mode.

2. The refrigeration circuit of claim 1, further comprising an EVI component disposed at an input of the at least one expansion valve.

3. The refrigeration circuit of claim 2, wherein the EVI component includes an EVI expansion valve and an economizer, an output of the EVI expansion valve is fluidly connected to an input of the compressor.

4. The refrigeration circuit of claim 1, wherein one of the first and second heat exchanger is disposed downstream of the expansion valve and the other of the first and second heat exchanger is disposed upstream of the expansion valve.

5. The refrigeration circuit of claim 1, further comprising first and second valves in parallel and a four-way valve, the first and second valves are fluidly connected to an outlet of the compressor, the four-way valve is fluidly connected to the first valve at a downstream position, and the second valve is fluidly connected to an inlet of the third heat exchanger.

6. The refrigeration circuit of claim 5, wherein the first and second heat exchanger each have an input/output port fluidly connected to the four-way valve.

7. The refrigeration circuit of claim 1, wherein the third heat exchanger is a hot-water heat exchanger configured to supply hot water.

8. The refrigeration circuit of claim 1, wherein when one of the first, second and third heat exchangers is idle, the idle heat exchanger stores liquid refrigerant.

* * * * *